United States Patent [19]

Brown et al.

[11] Patent Number: 4,910,432

[45] Date of Patent: Mar. 20, 1990

[54] CERAMIC METAL HALIDE LAMPS

[75] Inventors: Kenneth E. Brown, Ratby; Kevin Hick, Syston; Gary K. Caunt, Thurmaston; Bruce H. S. Rambaldini, Syston, all of England

[73] Assignee: Thorn EMI plc, London, England

[21] Appl. No.: 173,095

[22] Filed: Mar. 28, 1988

[30] Foreign Application Priority Data

Mar. 31, 1987 [GB] United Kingdom ..... 8707670

[51] Int. Cl.[4] ..... H01J 61/073; H01J 61/36

[52] U.S. Cl. ..... 313/620; 313/624; 313/625; 313/642

[58] Field of Search ..... 313/620, 621, 623–625, 313/638, 639, 642

[56] References Cited

U.S. PATENT DOCUMENTS 3,259,777 7/1966 Fridrich ..... 313/631

4,475,061 10/1984 Van de Weijer et al. ..... 313/623

4,585,972 4/1986 Hing ..... 313/636

4,594,529 6/1986 de Vrijer ..... 313/620

OTHER PUBLICATIONS

"Tin Sodium Halide Lamps in Ceramic Envelopes", by K. E. Brown, et al., Journal of IES, Jan. 1982, pp. 106 through 114.

*Primary Examiner*—Donald J. Yusko

*Assistant Examiner*—Michael Horabik

*Attorney, Agent, or Firm*—Fleit, Jacobson, Cohn, Price, Holman & Stern

[57] ABSTRACT

A ceramic metal halide high pressure discharge lamp has an arc gap separating the discharge electrodes which is not more than 10 mm and a wall loading which is at least 50 W $cm^{-2}$. The relatively small arc gap enables a relatively low operating voltage (in the range from 80V to 130V, say) to be used.

8 Claims, 1 Drawing Sheet

CERAMIC METAL HALIDE LAMPS

Figure 1:
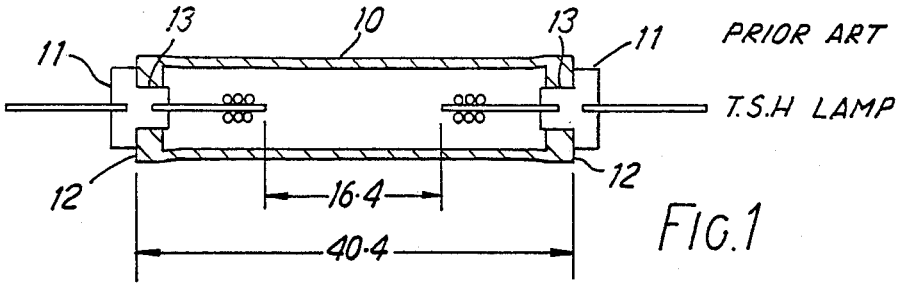

This invention relates to high pressure ceramic metal halide (CMH) discharge lamps. More particularly the invention is concerned with providing a commercially acceptable CMH discharge lamp, that is to say, a discharge lamp comprising suitable metal halide vapours hermetically sealed within a discharge arc tube of a light-transmitting ceramic material and designed to operate with a lamp voltage drop of between 80 to 130 volts. With a voltage drop in this range the lamp could be powered by from a standard 220–240 V supply using a commercially available starting circuit, such as a standard wire wound choke ballast or a series capacitor circuit. Moreover, in order to be commercially acceptable it is preferable that the lamp should be capable of operating in the horizontal mode.

A CMH lamp is proposed in a paper by Brown et al entitled "Tin Sodium Halide Lamps in Ceramic Envelopes" published IES conference 9 Aug., 1981 describing what is hereinafter referred to as the TSH lamp. This lamp, which was developed by optimising efficacy is found to be inconvenient from an operational standpoint, not least because it is designed to operate with a transformer ballast requiring a lamp voltage of 200–240 V. This would mitigate against the lamp being put into general commercial use. Furthermore, because of the limitations of conventional sealing techniques, the end seals of a TSH lamp attain a temperature of around 600° C., and the effective cool spot temperature for the lamp would be no greater than about 700° C. In practice, an effective cool spot temperature somewhat higher than 700° C. would be desirable. Also, the TSH lamp is limited to a vertical mode operation.

The effective cool spot temperature referred to throughout this specification is measured by comparing the lamp spectrum obtained during normal operation with the spectra obtained when one end of the lamp arc tube is maintained, in a bath of molten indium, at different test temperatures. The effective cool spot temperature is deemed to be that test temperature giving the closest match of spectra.

An investigation into an experimental ceramic metal halide lamp is reported in the paper "New Structure of Ceramic Metal Halide Lamps—their characteristics" by M Kitagawa, S Yamayaki and K Tabatsu of the Iwasaki Electric Co. presented at the I.E.S/Conference in Japan, March, 1985. No details are given of the electrical characteristics of the experimental lamp and experimental lamps were life tested to 1,000 hours only, under an input of 150 W, before being analysed. According to the report damage to the ends of the lamp when operating at temperature between 800 and 900° C. was very severe.

It is therefore an object of the present invention to provide an improved Ceramic Metal Halide lamp which alleviates at least some of the afore-mentioned problems.

According to the present invention there is provided a ceramic metal halide high pressure discharge lamp adapted to operate at a seal operating temperature of up to 1000° C., the lamp comprising an arc tube made of a light-transmissive ceramic material, containing a fill comprising a metal halide dose, mercury and a rare gas for starting, and an end closure member hermetically sealing each end of the arc tube and supporting a respective discharge electrode, wherein the arc gap separating said discharge electrodes is not greater than 10 mm and the wall loading on the arc tube is at least 50 W $cm^{-2}$.

The wall loading is defined here as the ratio of lamp input power to the internal surface area of that part of the arc tube surrounding the arc gap. In the case of a cylindrical arc tube the relevant internal surface area is evaluated as the inner circumference of the arc tube multiplied by the arc gap.

As stated hereinbefore a main requirement of a commercially acceptable ceramic metal halide lamp is the requirement of a voltage drop of between 80 to 130 volts. Assuming that the mercury pressure is fixed for high efficancy (70 lumens/W to 100 lumen/W, for example) the desired voltage drop imposes a required Watts per mm of arc gap value which in turn determines the wall loading for a given diameter of arc tube.

The afore-mentioned papers by Brown et al and Kitagawa et al describe CMH lamps having maximum wall loadings of about 40 W $cm^{-2}$ and 37 W $cm^{-2}$ respectively. The inventors have discovered that contrary to expectation a ceramic arc tube can operate satisfactorily at significantly greater wall loadings that is greater than 50 W $cm^{-2}$, and typically in the range from 80 W $cm^{-2}$ to 160 $cm^{-2}$. A wall loading in the range from 90 W $cm^{-2}$ to 100 W $cm^{-2}$ is preferred and a wall loading of approximately 90 W $cm^{-2}$ is found to be particularly satisfactory.

The inventors have recognised that the larger wall loading permits use of a relative small arc gap commensurate with the afore-mentioned desired voltage drop (i.e. 80 V14 130 V). The inventors find that the arc gap should not be greater than 10 mm and preferably not less than 5 mm. In an example an arc gap of 7.3 mm was used.

Moreover, whereas the TSH lamp has an aspect ratio of about 2.2, a lamp in accordance with the present invention may have a significantly lower aspect ratio, typically in the range from 0.7 to 1.4., aspect ratio being defined as the ratio of arc gap to arc tube internal diameter. The lower aspect ratio achievable with the present invention reduces damage to the arc tube wall due to bowing of the discharge arc allowing the tube to be operate in a horizontal mode. Also the reduced aspect ratio leads to a higher arc tube wall temperature, and so a higher effective cool spot temperature which, as described hereinbefore, is generally desirable.

With a configuration in accordance with the present invention a seal operating temperature of at least 700° C. and up to 1000° C. is envisaged. The increase of at least 100 centigrade degree over the seal operating temperature of 600° C. reported by Brown et al for the TSH lamp enables a less corrosive, less volatile, dose comprising indium, thallium and sodium to be used instead of the more agressive dose of tin and sodium used in the TSH lamp.

Figure 2:
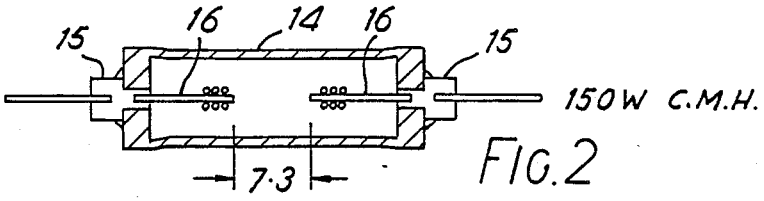
Figure 3:
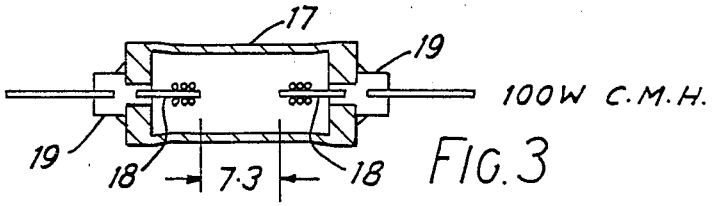
Figure 4:
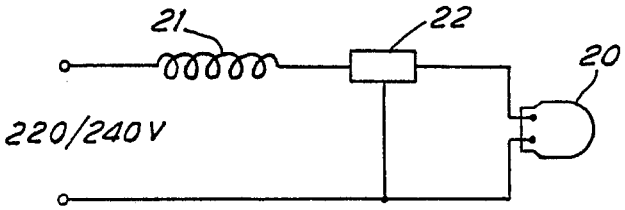
Figure 5:
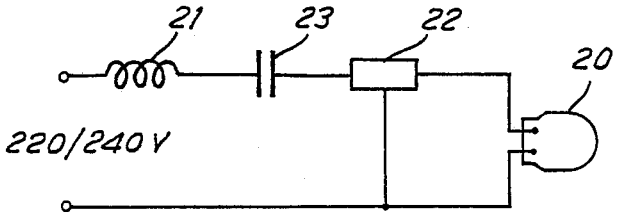

In order that the invention may be carried into effect particular embodiments thereof are now described, by way of example only, by reference to the accompanying drawings of which FIG. 1 illustrates a known TSH lamp as described in the afore-mentioned paper by Brown et al, FIGS. 2 and 3 shown longitudinal, cross-sectional views through two CMH lamps in accordance with the present invention and FIGS. 4 and 5 show circuits for use with the CMH lamps of FIGS. 2 and 3.

Referring to FIG. 1 a known TS lamp comprising a polycrystalline alumina arc tube 10 has an overall length of approximately 40.4 mm and an arc gap of approximately 16.4 mm. The metal halide dose of tin sodium halide plus mercury and rare gas for starting is hermetically sealed within ceramic arc tube 10 by means of electrically conductive cermet end closure members 11. These are seen to cover ends 12 of the arc tube almost entirely and are sealed to the arc tube by means of a suitable metal halide resistant sealing material 13.

FIG. 2 illustrates an example of a CMH lamp in accordance with the present invention. In contrast to the lamp of FIG. 1 the arc tube 14, which is also made of polycrystalline alumina, is much shorter −27.8 mm in overall length—and has a smaller arc gap of only 7.3 mm. With an input power of 150 W and an arc tube internal diameter of 7.35 mm the wall loading is approximately 90 W/cm$^2$, and with the reduced arc gap the required voltage drop of 80 to 130 volts can be achieved.

Arc tube 14 is hermetically sealed by electrically conductive cermet end closure members 15 sealed to the ends of the arc tube 14 by suitable metal halide resistant sealing material (not shown) which is melted and seals between the interfaces of the cermet member 15 and arc tube 14. With a backspacing of approximately 7 mm, represented by reference numeral 16, arc gap 7.3 mm and arc tube internal diameter 7.35 mm the embodiment of FIG. 2 achieves an effective aspect ratio of about 1. This configuration enables the lamp to operate at an increased seal temperature of 770° C. The higher operating temperature allows the less aggressive dose of sodium, thallium and indium to be used instead of the more aggressive tin, sodium halide dose which, in turn, leads to reduced electrode corrosion and an increased operating lifetime. Moreover, with the geometry shown, bowing of the discharge arc is much reduced or eliminated allowing the lamp to be used in the horizontal mode. This substantially increases the commercial viability of the lamp.

In addition, the relatively high seal (and so effective cool spot) temperatures which can be achieved with this configuration give rise to a significant, and beneficial, broadening of the major spectral lines, namely the lines at 589 nm, 535 nm and 451 nm produced by sodium, indium and thallium halides respectively. Furthermore, the inventors have found that a substantial continium, the origin of which is not fully understood, accounts for up to 30% of the visible light which is produced by the lamp and contributes to the production of an excellent colour rendering index, Ra, of 80 in this example.

In order to reduce end losses by radiation due to the high emittance of the cermet end members, end members 15 are of much reduced size as compared with the cermet end caps used in the TSH lamp. In the example of FIG. 2 the cermet end members 15 are 3.8 mm diameter and cover just over 50% of the end area of the arc tube representing a major reduction in size as compared with the cermet end caps used in the TSH lamp illustrated in FIG. 1 wherein it can be seen the end caps of end member 11 cover substantially the whole of the end area of arc tube 10. Since the sealing material has to be heated to its melting temperature of 1500°–1600° C. it has been found surprisingly that the large amount of heat, which has to be applied through the much reduced size of the cermet end member in order to achieve the melting temperature, does not result in cracking of arc tube 14 even though extremely short sealing times are required in order to prevent evaporation of the dose.

FIG. 3 is an illustration of a 100 W CMH lamp in accordance with the present invention. The overall length of polycrystalline alumina arc tube 17 has been reduced to 21.3 mm but the arc gap has been maintained at 7.3 mm. Back spacing 18 has been reduced slightly so that the operating temperature of the ends is slightly higher at 850° C. As with the embodiment of FIG. 2 the diameter of electrically conducting cermet end members 19 is about 50% of the diameter of end caps 11 of the TSH lamps of FIG. 1. With the geometry shown the wall loading is about 60 W/cm$^2$.

Table 1 sets out a comparison of the afore-mentioned TSH lamp and five examples (1–5) of CMH lamp in accordance with the present invention.

TABLE 1

| | | PRESENT INVENTION | | | | |
|---|---|---|---|---|---|---|
| | TSH | EXAMPLE 1 | EXAMPLE 2 | EXAMPLE 3 | EXAMPLE 4 | EXAMPLE 5 |
| ARC LENGTH (mm) | 16 | 7.3 | 7.3 | 7.3 | 5.9 | 9.0 |
| TUBE BORE (mm) | 7.34 | 7.34 | 7.34 | 7.34 | 8.1 | 8.1 |
| OVERALL LENGTH (mm) | 40 | 27.8 | 21.3 | 27.8 | 27.0 | 29 |
| POWER INPUT (W) | 150 | 150 | 100 | 150 | 150 | 250 |
| WALL LOADING ($Wcm^{-2}$) | 40 | 88 | 59 | 88 | 100 | 155 |
| ORIENTATION | VERTICAL | VERTICAL | VERTICAL | HORIZONTAL | HORIZONTAL | HORIZONTAL |
| EFFECTIVE COOL SPOT TEMP (°C.) | 700 | 875 | 890 | 960 | 950 | 975 |
| VOLTAGE DROP (V) | 200–240 | 90 | 100 | 103 | 90 | 116 |
| LUMENS (lm) | 14000 | 12000 | 6000 | 10800 | 11550 | 21706 |
| EFFICANCY (lm/W) | 93 | 80 | 60 | 72 | 77 | 87 |
| CCT (K) | 3800 | 4000 | 3600 | 3000 | 3100 | 2805 |
| Ra | 70 | 80 | 80 | 85 | 87 | 92 |
| DOSE | 0.9 mg Na Cl | 6.2 mg Na I | 4.5 mg Na I | 6.2 mg Na I | 6.2 mg Na I | 6.2 mg Na I |
| | 8.9 mg $Hg_2Cl_2$ | 1.3 mg Tl Br | 0.5 mg Tl Br | 1.3 mg Tl Br | 1.3 mg Tl Br | 1.3 mg Tl Br |
| | 5.7 mg $HgI_2$ | 0.4 mg $HgI_2$ | 0.30 mg $HgI_2$ | 0.4 mg $HgI_2$ | 0.4 mg $HgI_2$ | 0.4 mg $HgI_2$ |
| | 7.3 mg Sn | 0.2 mg In | 0.15 mg In | 0.2 mg In | 0.2 mg In | 0.2 mg In |
| | 29 mg Hg | 20 mg Hg | 12 mg Hg | 20 mg Hg | 27 mg Hg | 27 mg Hg |

Use of a highly volatile metal halide doses, of course, present problems in sealing the ends of the ceramic arc tube and in order to provide satisfactory seals for ceramic metal halide lamps to both operate at about 700° C. and up to 1,000° C. the finished seals must have a softening temperature not less than about 1300° C. One method of achieving a satisfactory seal is that disclosed in our European patent application No. 86306645.2 published under No. 0220813 which discloses a method of rapidly sealing the arc tube complete with dose by first forming a glassy seal from a MgO, $Al_2O_3$, $SiO_2$, sealing composition and then converting it to a highly refractory crystalline seal. The success of this method is probably dependent entirely on the speed at which the complete sealing process is carried out and a sealing process lasting about 60 seconds is found to be particularly useful.

FIG. 4 is a diagram of an electric circuit designed to operate a nominal 150 W CMH lamp 20 having a nominal voltage drop of 100 V from a 240 V supply. As can be seen from FIG. 4 a simple series inductor ballast 21 having an impedance of 110 ohms at 1.8A and a power factor of 0.06 is connected to an igniter 22 generating pulses of between 3 to 5 kV.

An alternative circuit is shown in FIG. 5 which includes a series capacitor 22, of about 14 $\mu$F having a working voltage of 450 V. This circuit has the advantage of greater stability against supply voltage variation, a reduced tendency to flicker and improved starting characteristics.

It will be understood that the ceramic arc tube used in CMH lamps in accordance with this invention need not necessarily be cylindrical. Alternatively arc tubes having a bulbous form could be used.

Furthermore, it will be understood by those skilled in the art that a CMH arc lamp according to the present invention can be incorporated in a variety of outer envelopes to provide a finished product.

We claim:

1. A ceramic metal halide high pressure discharge lamp adapted to operate at a seal operating temperature of up to 1000° C., the lamp comprising: an arc tube made of a light-transmissive ceramic material and having ends of a cross-sectional area, the arc tube containing a fill comprising a metal halide dose, mercury and a rare gas for starting;

and an end closure member hermetically sealing each end of the arc tube and supporting a respective discharge electrode, the arc gap separating said discharge electrodes being not greater than 10 mm;

wherein the end closure member is made of an electrically conductive cermet material and has a cross-sectional area just over 50% or less of said cross-sectional area of the ends of the arc tube, and the wall loading, in use, on the arc tube is at least 50 $Wcm^{-2}$.

2. A ceramic metal halide high pressure discharge lamp according to claim 1 wherein the arc gap is in the range from 5 mm to 10 mm.

3. A ceramic metal halide high pressure discharge lamp according to claim 1 wherein the wall loading on the arc tube is from 80 W $cm^{-2}$ to 160 W $cm^{-2}$.

4. A ceramic metal halide high pressure discharge lamp according to claim 3 wherein the wall loading on the arc tube is from 90 W $cm^{-2}$ to 100 W $cm^{-2}$.

5. A ceramic metal halide high pressure discharge lamp according to claim 1 wherein the arc tube is cylindrical.

6. A ceramic metal halide high pressure discharge lamp according to claim 5 wherein the arc tube has an aspect ratio in the range from 0.7 to 1.4, aspect ratio being defined as the ratio of arc gap to arc tube internal diameter.

7. A ceramic metal halide high pressure discharge lamp according to claim 1 wherein said metal halide dose comprises indium, thallium, sodium and a halogen.

8. A ceramic metal halide high pressure discharge lamp according to claim 7 wherein said halogen is iodine or bromine.

* * * * *